US006431686B2

(12) United States Patent
Saul et al.

(10) Patent No.: US 6,431,686 B2
(45) Date of Patent: Aug. 13, 2002

(54) FLUID EJECTION DEVICE CONTROLLED BY ELECTRICALLY ISOLATED PRIMITIVES

(75) Inventors: Kenneth D Saul; Joseph M. Torgerson, both of Philomath; Angela W Bakkom; Mark H. MacKenzie, both of Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/912,019

(22) Filed: Jul. 23, 2001

Related U.S. Application Data

(63) Continuation of application No. 09/386,548, filed on Aug. 30, 1999.

(51) Int. Cl.[7] ..... B41J 2/05; B41J 29/38
(52) U.S. Cl. ..... 347/57; 347/12
(58) Field of Search ..... 347/12, 13, 42, 347/57–59

(56) References Cited

U.S. PATENT DOCUMENTS

| | | | | |
|---|---|---|---|---|
| 4,862,197 | A | 8/1989 | Stoffel | 347/59 |
| 5,030,971 | A | 7/1991 | Drake et al. | 347/57 |
| 5,134,425 | A | 7/1992 | Yeung | 347/209 |
| 5,363,134 | A | 11/1994 | Barbehenn et al. | 347/49 |
| 5,541,629 | A | 7/1996 | Saunders et al. | 347/12 |
| 5,604,519 | A | 2/1997 | Keefe et al. | 347/13 |
| 5,644,342 | A | 7/1997 | Argyres | 347/12 |

FOREIGN PATENT DOCUMENTS

| | | | |
|---|---|---|---|
| EP | 0913257 A2 | 5/1999 | B41J/2/05 |

*Primary Examiner*—John Barlow
*Assistant Examiner*—Alfred Dudding

(57) ABSTRACT

A fluid ejection device has a first set of primitives within a first region of a substrate of the device, and a second set of primitives within a second region of the substrate. The second set of primitives is electrically isolated from said first set of primitives. The number of primitives of said first set of primitives is different from the number of primitives of said second set of primitives.

14 Claims, 8 Drawing Sheets

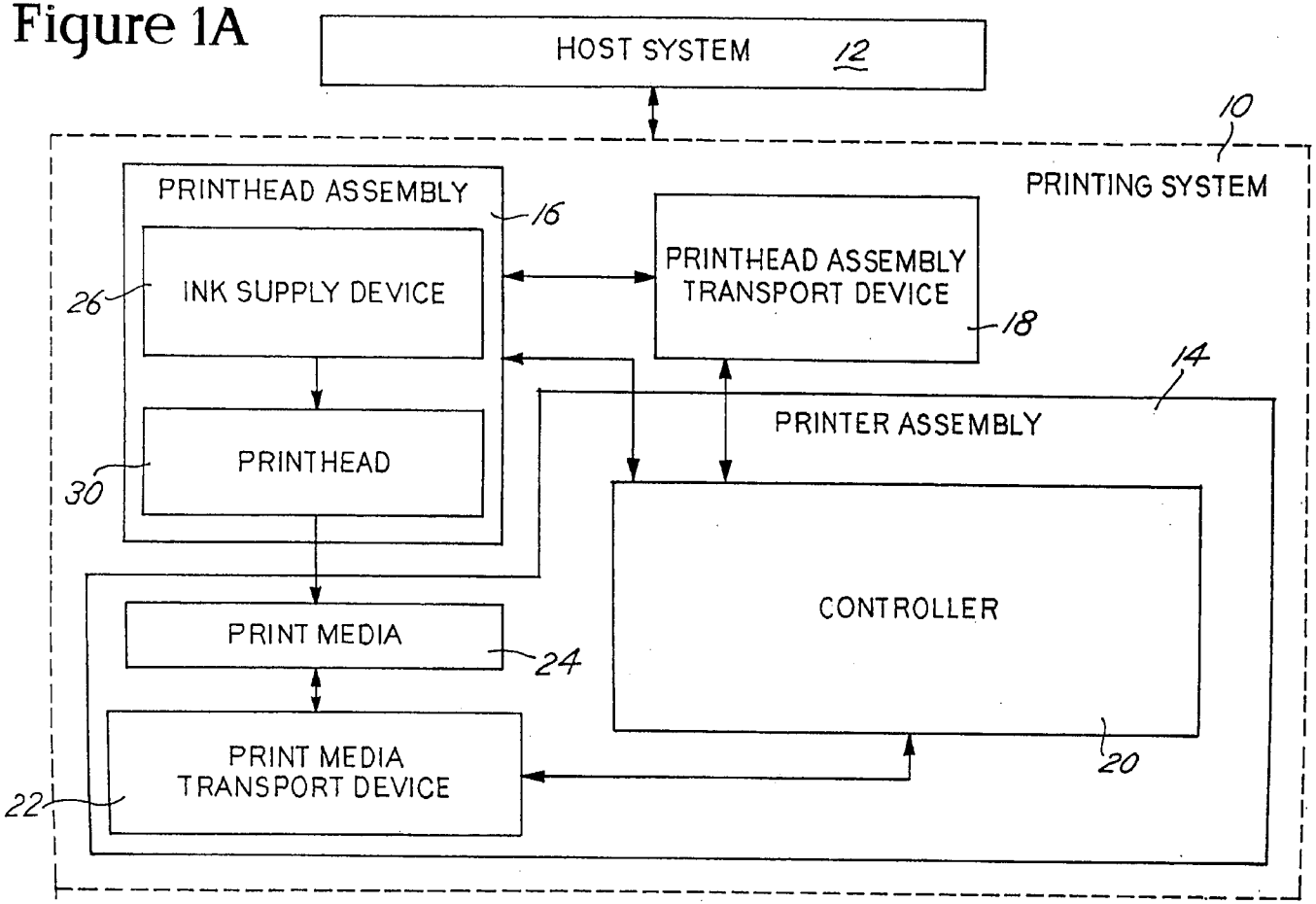
Figure 1A
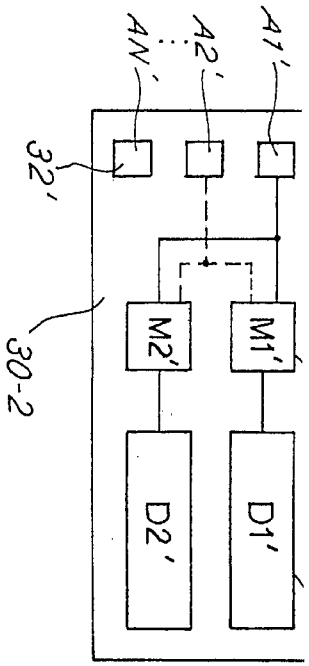

FLUID EJECTION DEVICE CONTROLLED BY ELECTRICALLY ISOLATED PRIMITIVES

CROSS-REFERENCE TO RELATED APPLICATION

This is a continuation of Ser. No. 09/386,548 filed Aug. 30, 1999.

FIELD OF THE INVENTION

The present invention relates generally to fluid ejection devices. In particular, the invention relates to fluid ejection device controlled by electrically isolated primitives.

BACKGROUND OF THE INVENTION

The art of inkjet printing technology is relatively well developed. Commercial products such as computer printers, graphics plotters, copiers, and facsimile machines successfully employ inkjet technology for producing hard copy printed output. The basics of the technology have been disclosed in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices have also been described by W. J. Lloyd and H. T. Taub in Output Hardcopy Devices (R. C. Durbeck and S. Sherr, ed., Academic Press, San Diego, 1988, chapter 13).

A thermal inkjet printer for inkjet printing typically includes one or more translationally reciprocating print cartridges in which small drops of ink, are ejected by thermal energy from a drop generator, towards a medium upon which it is desired to place alphanumeric characters, graphics, or images. Such cartridges typically include a print head having an orifice member or plate that has a plurality of small nozzles through which the ink drops are ejected. Beneath the nozzles are ink firing chambers, which are enclosures in which ink resides prior to ejection through a nozzle. Ink is supplied to the ink firing chambers through ink channels that are in fluid communication with an ink reservoir, which may be contained in a reservoir portion of the print cartridge or in a separate ink container spaced apart from the print head.

Ink drop ejection through a nozzle employed in a thermal inkjet printer is accomplished by quickly heating the volume of ink residing within the ink firing chamber with a selectively energizing electrical pulse to a heater resistor ink ejector positioned in the ink firing chamber. At the commencement of the heat energy output from the heater resistor, an ink vapor bubble nucleates at sites on the surface of the heater resistor or its protective layers. The rapid expansion of the ink vapor bubble forces the liquid ink through the nozzle. Once the electrical pulse ends and an ink drop is ejected, the ink firing chamber refills with ink from the ink channel and ink reservoir.

Thermal inkjet ink can be corrosive. Prolonged exposure of electrical interconnections of an ink cartridge to the ink, will frequently result in a degradation and failure of the print head because the transistors that fire the heater resistors are effectively cut off from their source of power or from their control signals. In some print head designs, the transistors that fire the heater resistors are addressed (controlled) from a single electrical connector. If this one connector is electrically disabled because of chemical attack from the ink and its constituents, a large part (or all) of an ink cartridge can fail, adversely affecting print quality.

The heater resistors of a conventional inkjet print head comprise a thin film resistive material deposited on an oxide layer of a semiconductor substrate. Electrical conductors are patterned over the oxide layer and provide an electrical path to and from each thin film heater resistor. Since the number of electrical conductors can become large when a large number of heater resistors are employed in a high density (high DPI—dots per inch) print head, various multiplexing techniques have reduce the number of conductors utilized to connect the heater resistors to circuitry disposed in the printer. See, for example, U.S. Pat. No. 5,541,629 "Print head with Reduced Interconnections to a Printer" and despite its good conductivity, imparts an undesirable amount of resistance in the path of the heater resistor.

Individual transistors are typically addressed using combinations of electrical signals applied to the drain, source and gate terminals. These combinations of signals can effectively control when individual transistors will be in their "on" state, thereby allowing a droplet of ink to be ejected onto the print medium. Multiplexing the function of the various lines through the semiconductors allows a large number of individual transistors to be addressed using a relatively small number of address line conductors.

Multiplexing techniques have helped reduce the total number of conductors utilized to energize the heater resistors. Notwithstanding the improvements in addressing, there remains a desire to reliably address each transistor to avoid catastrophic failure of a print head caused by a single fault on an address bus. In addition, there is a desire to provide printheads that have a flexibility to accept different input signal configurations.

SUMMARY

A fluid ejection device has a first set of primitives within a first region of a substrate of the device, and a second set of primitives within a second region of the substrate. The second set of primitives is electrically isolated from said first set of primitives. The number of primitives of said first set of primitives is different from the number of primitives of said second set of primitives.

Many of the attendant features of this invention will be more readily appreciated as the same becomes better understood by reference to the following detailed description and considered in connection with the accompanying drawings in which like reference symbols designate like parts throughout.

BRIEF DESCRIPTION OF THE DRAWINGS

FIG. 1A is a block diagram of a printing system employing an embodiment of the present invention.

DETAILED DESCRIPTION

Figure 1B:
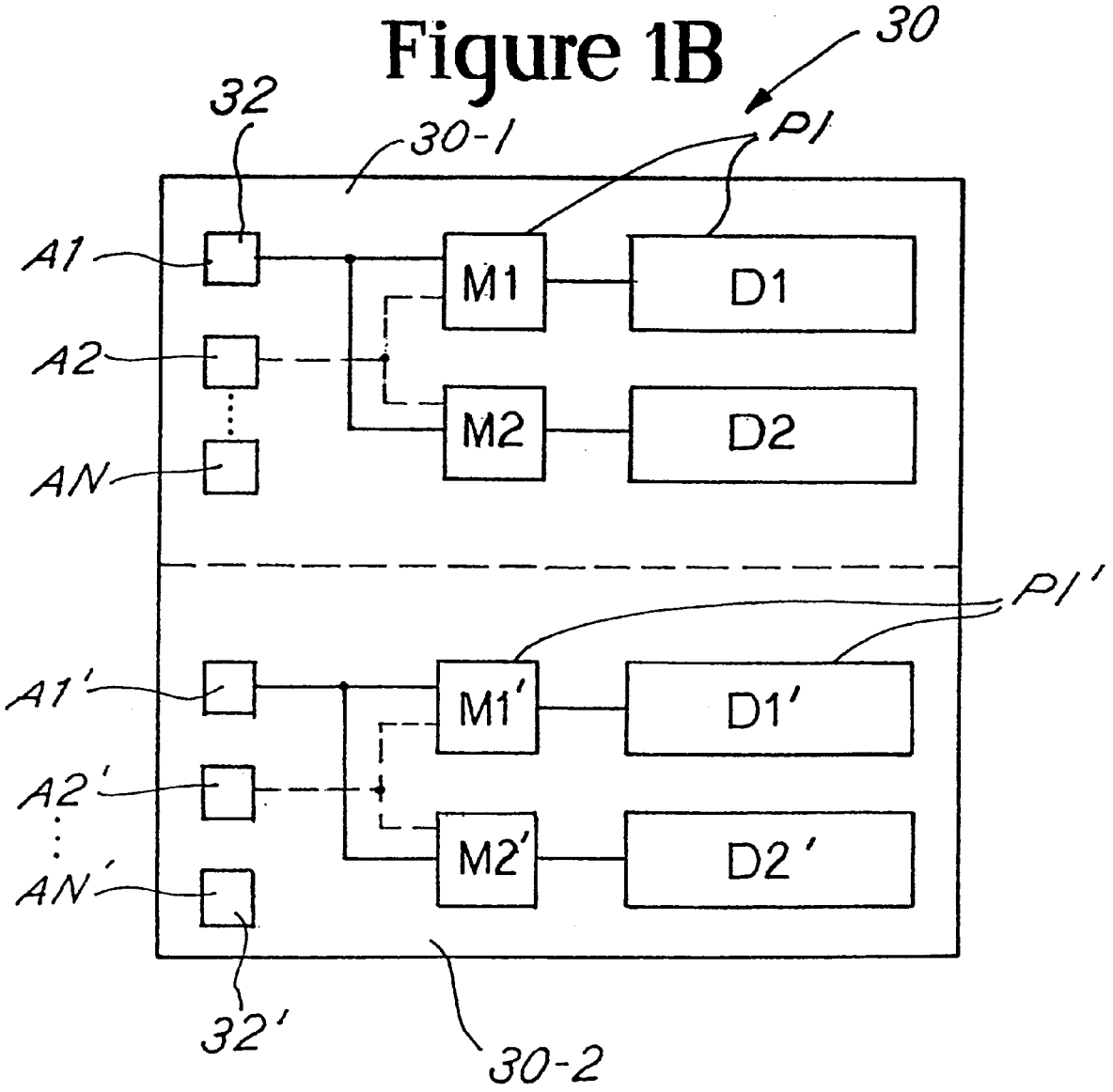
FIG. 1B is a simplified block diagram of the functional organization of the elements of a print head employing an embodiment of the present invention.

FIG. 1A is a block diagram of a printing system incorporating an embodiment of the present invention. The printing system 10 can be used for printing on any suitable material, such as paper media, transfer media, transparency media, photographic paper and the like. In general, the printing system communicates with a host system 12, which can be a computer or microprocessor that produces print data. The printing system 10 includes a printer assembly 14, which controls the printing system, a print head assembly 16 that ejects ink and in some embodiments, a print head assembly transport device 18 that positions the print head assembly 16.

The printer assembly 14 also includes a controller 20, a print media transport device 22 and a print media 24. The print media transport device 22 positions the print media 24 (such as paper) according the control instructions received from the controller 20. The controller 20 provides control to the print media transport device 22, the print head assembly 16 and the print head assembly transport device 18 according to instructions received from various microprocessors within the printing system 10. In addition, the controller 20 receives the print data from the host system 12 and processes the print data into printer control information and image data. This printer control information and image data is used by the controller 20 to control the print media transport device 18, the print head assembly 16 and the print head assembly transport device 18. For example, the print head assembly transport device 18 positions the print head 30 over the print media 24 and the print head 30 is instructed to eject ink drops according to the printer control information and image data.

The print head assembly 16 is preferably supported by a print head assembly transport device 18 that can position the print head assembly 16 over the print media 24. Preferably, the print head assembly 16 is capable of overlying any area of the print media 24 using the combination of the print head assembly transport device 18 and the print media transport device 22. For example, the print media 24 may be a rectangular sheet of paper and the print head assembly transport device 18 may position the paper in a media transport direction while the print head assembly transport device 18 may position the print head assembly 16 across the paper in a direction transverse to the media transport direction.

The print head assembly 16 includes an ink supply device 26 that is fluidically coupled to the print head 30 for selectively providing ink to the print head 30. The print head 30 includes a plurality of ink drop delivery systems, such as an array of inkjet nozzles or drop generators. The ink jet nozzles are comprised of orifices through an orifice plate through which ink is ejected when the ink is heated to boiling. As discussed further below, each ink drop delivery system forms a printed image by ejecting droplets of ink onto the print media 24 according to instructions from the controller 20.

Figure 3:
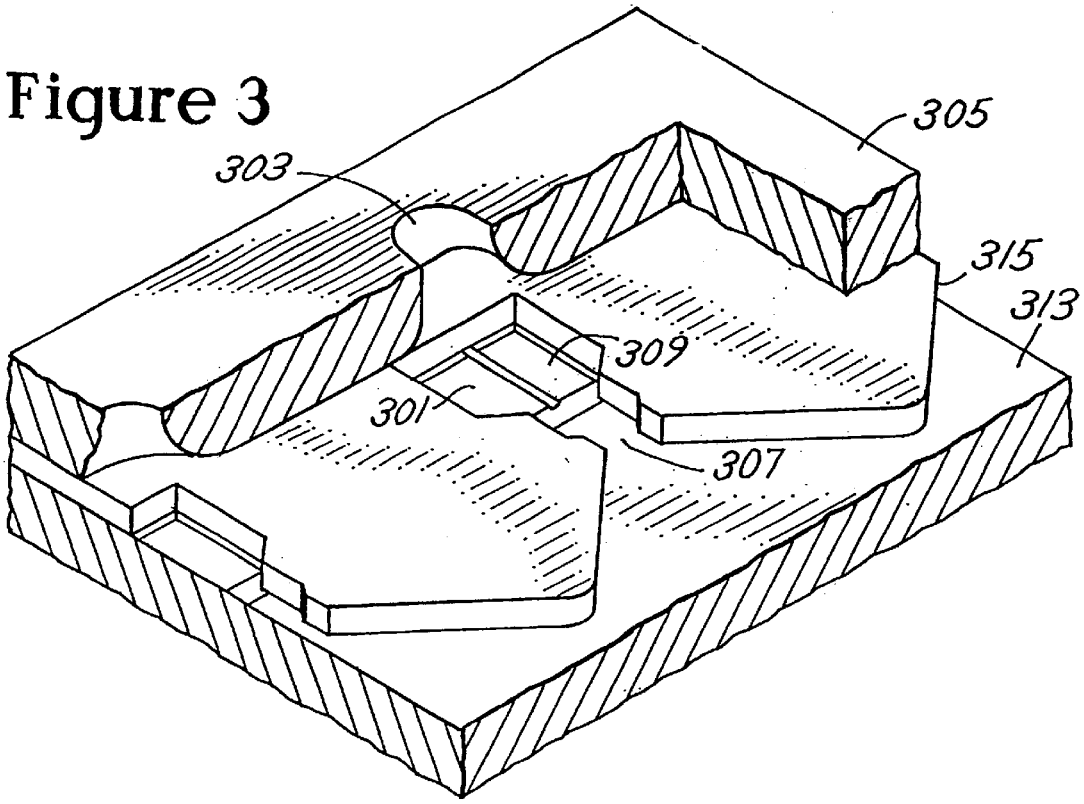
FIG. 3 is a magnified isometric cross section of an ink drop generator employed in the print cartridge print head of the printer of FIG. 2A.

FIG. 3 shows an isometric view of the top of a substrate 313 on which is formed a barrier layer 315 that is shaped to direct ink to flow through a passage 307 into an ink firing chamber 301. At the "bottom" of the ink firing chamber 301 is a thin film heater resistor 309 that is covered by a protective dielectric layer (not shown). When current is forced through the heater resistor 309, ink in the firing chamber 301 is boiled causing the ink to be expelled through an orifice 303 in the orifice plate or top plate 305 that is placed over the barrier layer 315. By capillary action, ink is retained in the firing chamber 301 until electrical current to the heater resistor heats the ink. The electrical current through the heater resistor therefore determines when ink is ejected from the orifice 303.

FIG. 1B is a simplified block diagram depicting print head or substrate 30 of the present invention in greater detail. For the purposes of the illustrative example in FIG. 1B, element 30 may be considered to be a semiconductor substrate such as a silicon substrate that incorporates inkjet drop generators and associated circuitry. Alternatively, element 30 can represent a combination of a rigid semiconductor substrate and a flexible circuit for carrying signals between a printing system and the drop generators on print head 30.

Substrate 30 is divided into two regions, 30-1 and 30-2. Alternate embodiments of the invention disclosed herein would of course include a substrate divided into more than two regions. Each region shown in FIG. 1B contains a set of primitives. Hereinafter, a "primitive" is comprised of a collection of transistors (FETs) that are turned on (and off) by voltages applied to (or removed from) control lines coupled to the FETs. All of the FETs in a primitive typically have their drain (or source) terminals coupled to a common ground; all of these FETs typically have their sources (or drains) coupled to a power source through individual and corresponding thin film heater resistors on the surface of the substrate. The power is a "primitive select" signal on a "primitive select" line discussed below. Alternate embodiments would also include using unique grounds for the FETs. Each FET then has its gate coupled to an address line, the voltages of which control the FET individually. The FETs, heater resistors and "lines" to and from the FETs and external connection points (connectors) all are considered to be fabricated "on" the substrate 30. The "lines" are typically comprised of conductive traces fabricated on the substrate using appropriate semiconductor fabrication techniques.

Figure 4:
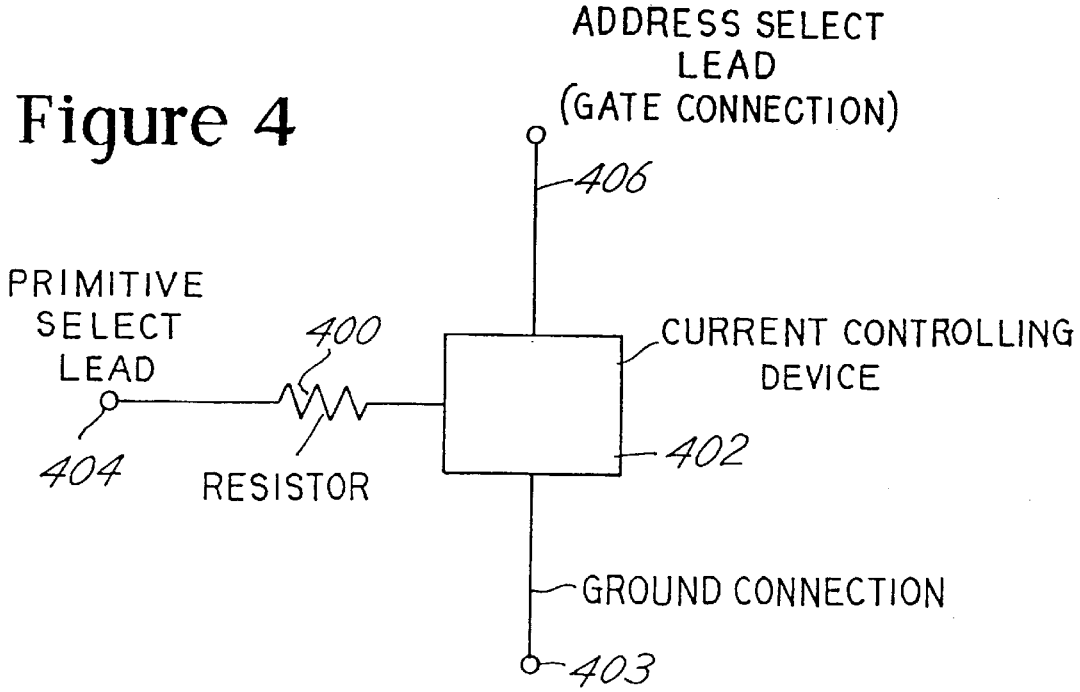
FIG. 4 is a schematic diagram of a single FET, heater resistor and electrical connections of the FET employed in a "primitive" switching device that can be employed in an embodiment of the present invention.

One of the control lines to the primitive is considered to be a primitive control line—not shown in FIG. 1B but shown in FIG. 4 as the primitive select lead 404. This primitive control line (404 in FIG. 4) applies V+(or ground) to the source or drain terminals of the FETs in a primitive (through the heater resistor 400 in FIG. 4). The other control line of an FET in a primitive is an address line coupled to the FET's gate, identified in FIG. 4 by reference numeral 406. The gate of each FET of a primitive is coupled to a unique address line permitting the FETs of a primitive to be individually activated. When the primitive control line to a primitive is active (primitive select line 404 in FIG. 4) and an address line (406 in FIG. 4) to a FET gate in the same primitive is active, that FET (402 in FIG. 4) will carry current through the corresponding heater resistor (400 in FIG. 4), causing ink to be ejected from the print head.

The sequence of turning "on" and "off" the transistors is as follows. If a transistor is "on" and conducting current, and thereafter the address line on the gate is turned "off" prior to the primitive control line being turned "off" the transistor can be damaged by avalanche breakdown, as well as other semiconductor failures. In the preferred embodiment, the address line is turned "on" prior to the primitive control line being turned "on." The address line should stay "on" until after the primitive control line has been turned off to avoid semiconductor failures.

FIG. 4 shows a single FET switching device 402 of a "primitive" and which acts to control current flow through a heater resistor 400 used to eject ink onto a print medium. The FET 402 of FIG. 4 is but one transistor of several such devices that make up a "primitive." Several such FETs would be coupled together sharing a common ground and having their source coupled to V+through a corresponding heater resistor. The relative direction and/or source of current through an FET is a design choice. Alternate embodiments would of course include coupling the FET source directly to V+with the FET drain coupled to ground through the heater resistor. Still other embodiments would include coupling the FET source to ground through the heater resistor and coupling the FET drain to a negative-polarity voltage.

The address lead 406 corresponds to (and is connected to) the FET gate. In the embodiment shown, power is applied to the FET primitive select lead 404, which in turn is connected to the FET through the heater resistor 400. The ground connection 403 provides the return path for current through the FET 402 such that when the gate is active and power is applied to the primitive select lead 404, current flows through the resistor, through the FET to ground. Only when both the primitive select and the address line on the gate are both active will the current flow through the resistor, through the FET to ground.

In a print head "primitive," which is a group of FETs coupled to a primitive select lead 404 through separate heater resistors 400 on the substrate, all of the FETs have power applied to them simultaneously. The FETs in the group are all connected to the common ground but each of the FETs in the group has its gate 406 coupled to an address line. Individual FETs in a group or "primitive" can be fired separately if the FET's primitive select lead 404 and gate 406 are active at the same time. Accordingly, a combination of a primitive select lead 404 and an address select lead (gate) 406 individually control each FET in a matrix fashion.

An ink jet print head can be made more reliable when the several primitives on an ink jet print head substrate (which surround or are proximate to an ink aperture) are organized into groups or clusters and when these groups of primitives are addressed by electrically separate address and primitive control lines. In the preferred embodiment, the primitives on a substrate are divided in half along a line transverse to the ink aperture. Primitives on one side of this line are addressed by one address bus; primitives on the other side are addressed by a different address bus. A fault on one address bus will therefore not affect primitives controlled by the other address bus.

Although the depiction of FIG. 1B shows only two primitives per region, alternate embodiments would include virtually any number of primitives on a substrate. Moreover, the primitives might be organized into more than two groups. Three or more groups might be controlled by three electrically separate address busses.

Each primitive shown in FIG. 1B (P1–P1') includes a plurality of heater resistors, also known in the art as drop generators D or D',and associated multiplexing circuitry M or M',including the FETs described above. The multiplexing circuitry receives signals from a plurality of power or primitive select or primitive control lines (not shown in FIG. 1B) and address select lines A or A'. The primitive control lines and the address lines together actuate the drop generators D or D' by firing the FETs, the current of which acts to eject droplets of ink during a printing operation. In order to properly activate a particular drop generator, a combination of a primitive select lines and an address select lines that is unique to that drop generator must be activated. A primitive select line connects to the source/drain of each transistor by way of the drop generator within the primitive associated with the primitive select line. An address select line 32 or 32' connects to the gate of one transistor in each of the primitives within region 30-1 or 30-2.

It is well known in the art that the gate of an FET can control when the device conducts. Alternate embodiments of the invention would include using other types of three-terminal current switching elements besides FETs including, but not limited to devices such as bi-polar transistors, SCRS, TRIACs and the like. In the case of a bipolar transistor for example, controlling the base voltage would control when the device conducts.

Figure 6A:
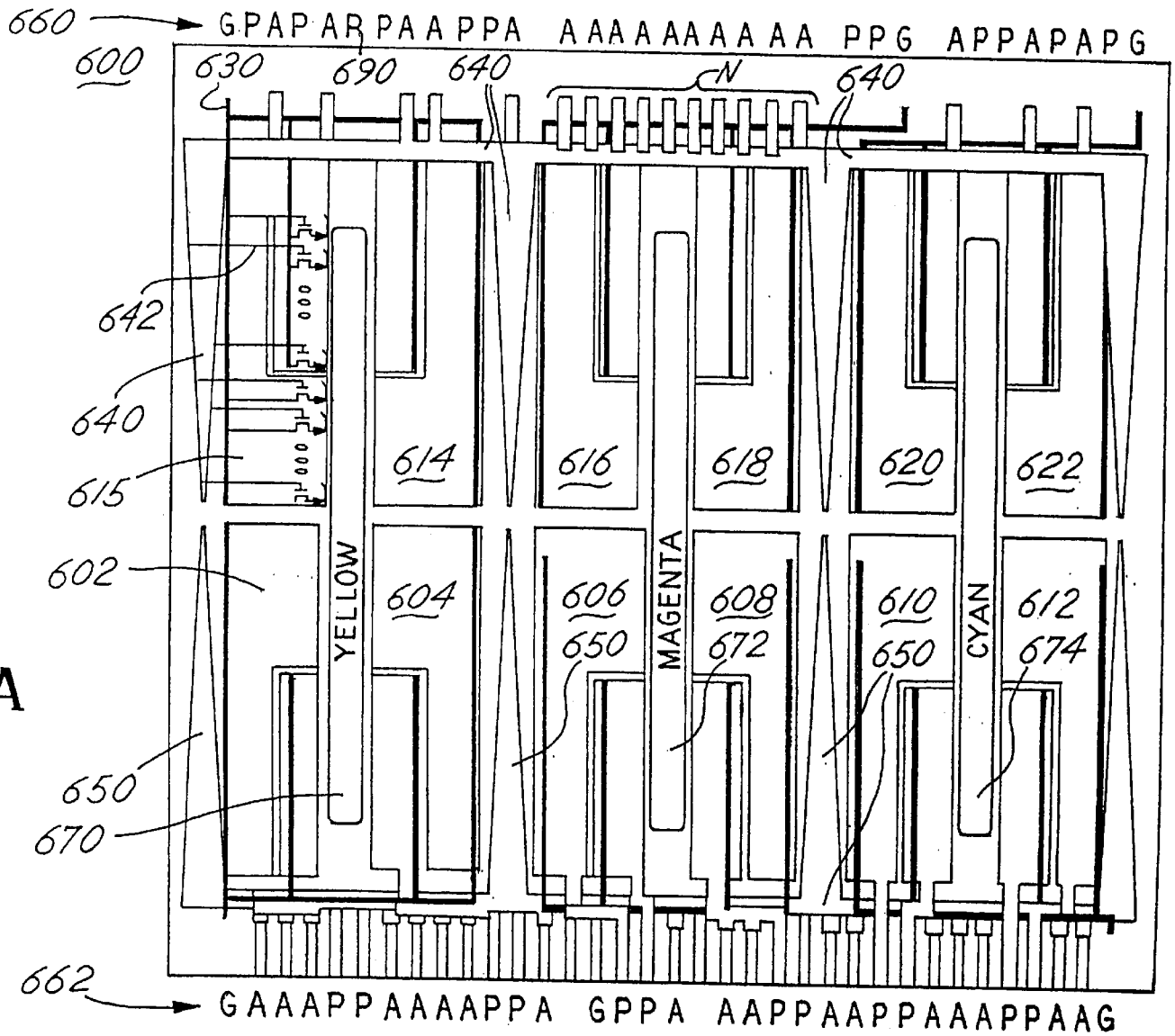
FIG. 6A shows a topographic view of a major surface of a three-color ink jet print head in one embodiment of the present invention.

FIG. 6A is a schematic plan view of a major surface of a three-color print head. In operation, yellow, magenta and cyan inks would flow upward, i.e. out of, the plane of the FIG. 6A through the ink apertures 670, 672 and 674 into firing chambers (shown in FIG. 3) distributed along both sides of the ink apertures 670, 672 and 674. Shaded, rectangular areas on opposite sides of the ink apertures (602, 604, 606, 608, 610, 612, 614, 615, 616, 618, 620, and 622) denote primitives. (Not shown in FIG. 6A, but existent in a preferred embodiment are twelve (12) additional primitives, each of which is adjacent to the enumerated primitives that are shown and the ink apertures, so as to provide a total of 24 primitives on the substrate. Each of the ink apertures therefore has eight primitives adjacent to it. Each of the eight primitives is comprised of 18 transistors.) As shown, the ink aperture 670 has four primitives 602, 604, 615 and 614 that are located about the ink aperture 670. One primitive, 615, schematically depicts the several FETs and heater resistors connected to them, proximate to one end and adjacent to one side of the ink aperture 670.

Each of the FETs of the primitive 615 is coupled to a ground bus 630 represented by a heavy line that can be seen on each of the primitive areas shown in the FIGS. (602, 604, 606, 608, 610, 612, 614, 615, 616, 618, 620, and 622).

A first address bus 640 is comprised of several conductors (individual conductors not shown), at least one of which is extended to each gate of each FET in the first set of primitives shown (614, 615, 616, 618, 620, and 622) in the upper or top portion of the substrate 600 shown in FIG. 6A. A second address bus 650 is comprised of several conductors (individual conductors not shown) at least one of which is extended to each gate of each FET in the primitives shown (602, 604, 606, 608, 610, 612) of a second set of primitives along the lower portion of the substrate 600 shown in FIG. 6A. The first and second address busses 640 and 650 are electrically isolated from each other but are accessible from the connectors 660 and 662 on the edges of the substrate 600.

In the preferred embodiment, each FET of a primitive has its gate terminal coupled to an address line 642. There are therefore a number of address lines "N" in an address bus 640, 650 that is equal to the number of drop generators (and FETs) in each of the primitives shown (602, 604, 606, 608, 610, 612, 614, 615, 616, 618, 620, and 622). The address lines to the gates of the FETs of one set of primitives shown (602, 604, 606, 608, 610, 612) are electrically isolated from the gates of the FETs of the other set of primitives shown (614, 615, 616, 618, 620, and 622). (In an alternate embodiment, the two sets of address lines may be indirectly or directly coupled together.) The FETs in any set of primitives will not fire if those FETs are deactivated by their corresponding primitive control lines, depicted in FIG. 6A as the "P" lines 690. The address lines are therefore effectively multiplexed to reduce the number of address lines utilized to control numerous transistors in several primitives while allowing for individual selectability (addressability) of the drop generators. The only exception to this would be if one or more truncated primitives P (with less than N drop generators) is utilized. During a printing operation, the printing system cycles through the address lines such that only one of the address lines A1 through AN is activated at a time. (See FIG. 6B.) Thus, within a primitive, only one drop generator can be activated at a time. However, all of the drop generators in the various primitives associated with a particular address can be fired simultaneously.

Referring back to FIG. 1B, each of the two regions 30-1 and 30-2 has its own set of separate address lines that control the firing of FETs in the corresponding region and which are preferably electrically isolated from each other so as avoid a fault on one line affecting all of the primitives that it is connected to. Thus, region 30-1 has a first set of address lines A1, A2, . . . , AN, terminating on the substrate in a set of address pads 32. Region 30-2 has a second set of addresses A1',A2', . . . , AN', separate from the first set and terminating in a separate set of address pads 32'.

As suggested earlier, one embodiment of print head 30 may be a combination of a silicon substrate and a flexible substrate.

In a first embodiment, the address pads 32 represent flexible circuit connections that connect to electronics in the printer assembly 14 when the print head assembly 16 is installed into printer assembly 14. Alternatively, in a second embodiment, the address pads 32 represent the bond pads on a silicon substrate. Intermediary circuitry such as a flexible circuit can be used to connect the bond pads to circuitry in printer assembly 14. One method for connection to such bond pads is known in the art as TAB bonding, or tape automated bonding.

In a third embodiment, the number of addresses A1,A2, . . . , AN in region 30-1 is equal to the number of addresses A1',A2', . . . . . , AN' in region 30-2 (although alternate embodiments would include using different numbers of address lines in each region.) In the third embodiment, jumpers or conductive traces on print head 30 or a flexible circuit attached to the print head 30 electrically connect the address A1 to address A1',address A2 to address A2', . . . , address AN to AN',etc. Thus, whenever address A is activated in section 30-1, a corresponding address A' is activated in section 30-2. By providing these separate connections for each address pair A and A',the crucial address connections are maintained even if a connection to one of them is lost. This assures that the proper signals are provided to print head 30 even if one of the address connections to print head 30 is lost.

In a fourth embodiment, the addresses in the sections 30-1 and 30-2 are electrically isolated. This allows the printer assembly to operate the print head in two modes. The printer can activate pairs of addresses A and A' simultaneously, allowing for a higher printer speed. One way to do this is might include having the printer assembly circuitry electrically couple the address lines in pairs. Alternatively, the printer can operate the addresses A and A' independently while combining primitives between region 30-1 and 30-2 in pairs. This lowers printer cost, but sacrifices speed.

Figure 2A:
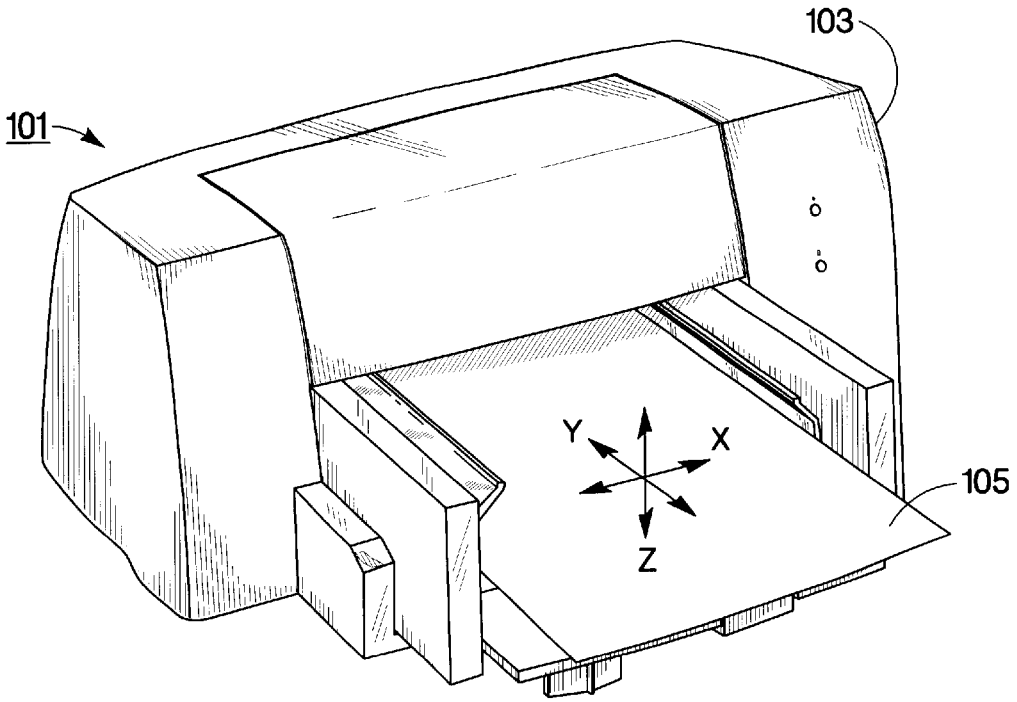
FIG. 2A is an isometric drawing of an exemplary printing apparatus employing an embodiment of the present invention.
Figure 2B:
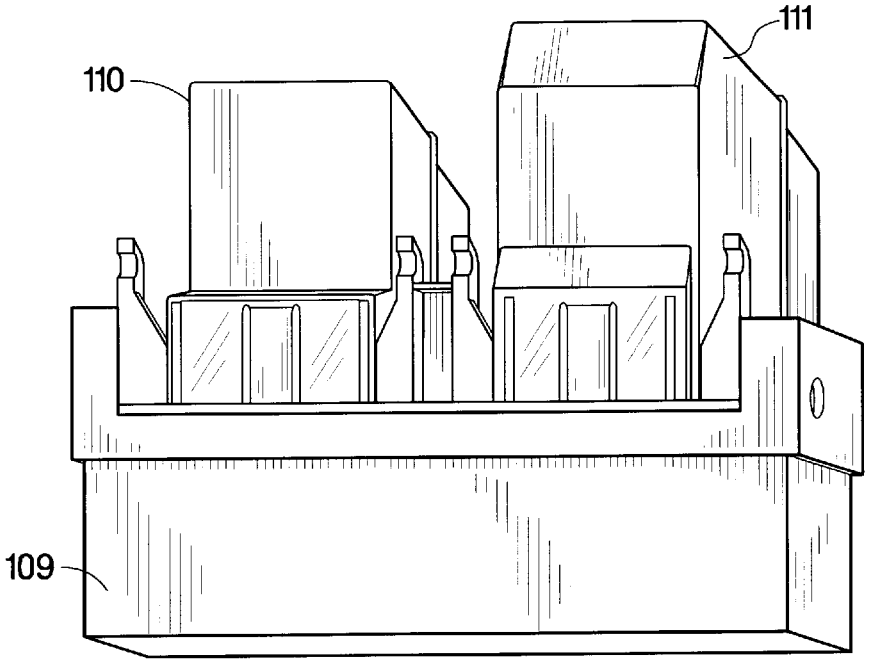
FIG. 2B is an isometric drawing of a print cartridge carriage apparatus employed in the printer of FIG. 2A.

An exemplary inkjet printing apparatus, a printer 101, that may employ the present invention is shown in outline form in the isometric drawing of FIG. 2A. Printing devices such as graphics plotters, copiers, and facsimile machines may also profitably employ the present invention. A printer housing 103 contains a printing platen to which an input print medium 105, such as paper, is transported by mechanisms that are known in the art. A carriage within the printer 101 holds one or a set of individual print cartridges capable of ejecting ink drops of black or color ink. Alternative embodiments can include a semi-permanent print head mechanism that is sporadically replenished from one or more fluidically-coupled off-axis ink reservoirs, or a single print cartridge having two or more colors of ink available within the print cartridge and ink ejecting nozzles designated for each color, or a single color print cartridge or print mechanism; the present invention is applicable to a print head employed by at least these alternatives. A carriage 109, which may be employed in the present invention and mounts two print cartridges 110 and 111, is illustrated in FIG. 2B. The carriage 109 is typically supported by a slide bar or similar mechanism within the printer and physically propelled along the slide bar to allow the carriage 109 to be translationally reciprocated or scanned back and forth across the print medium 105. The scan axis, X, is indicated by an arrow in FIG. 2A. As the carriage 109 scans, ink drops are selectively ejected from the print heads of the set of print cartridges 110 and 111 onto the medium 105 in predetermined print swatch patterns, forming images or alphanumeric characters using dot matrix manipulation. Conventionally, the dot matrix manipulation is determined by a user's computer (not shown) and instructions are transmitted to a microprocessor-based, electronic controller within the printer 101. Other techniques of dot matrix manipulation are accomplished by the computer's rasterizing the data then sending the rasterized data as well as print commands to the printer. The printer interprets the commands and rasterized information to determine which drop generators to fire.

Figure 2C:
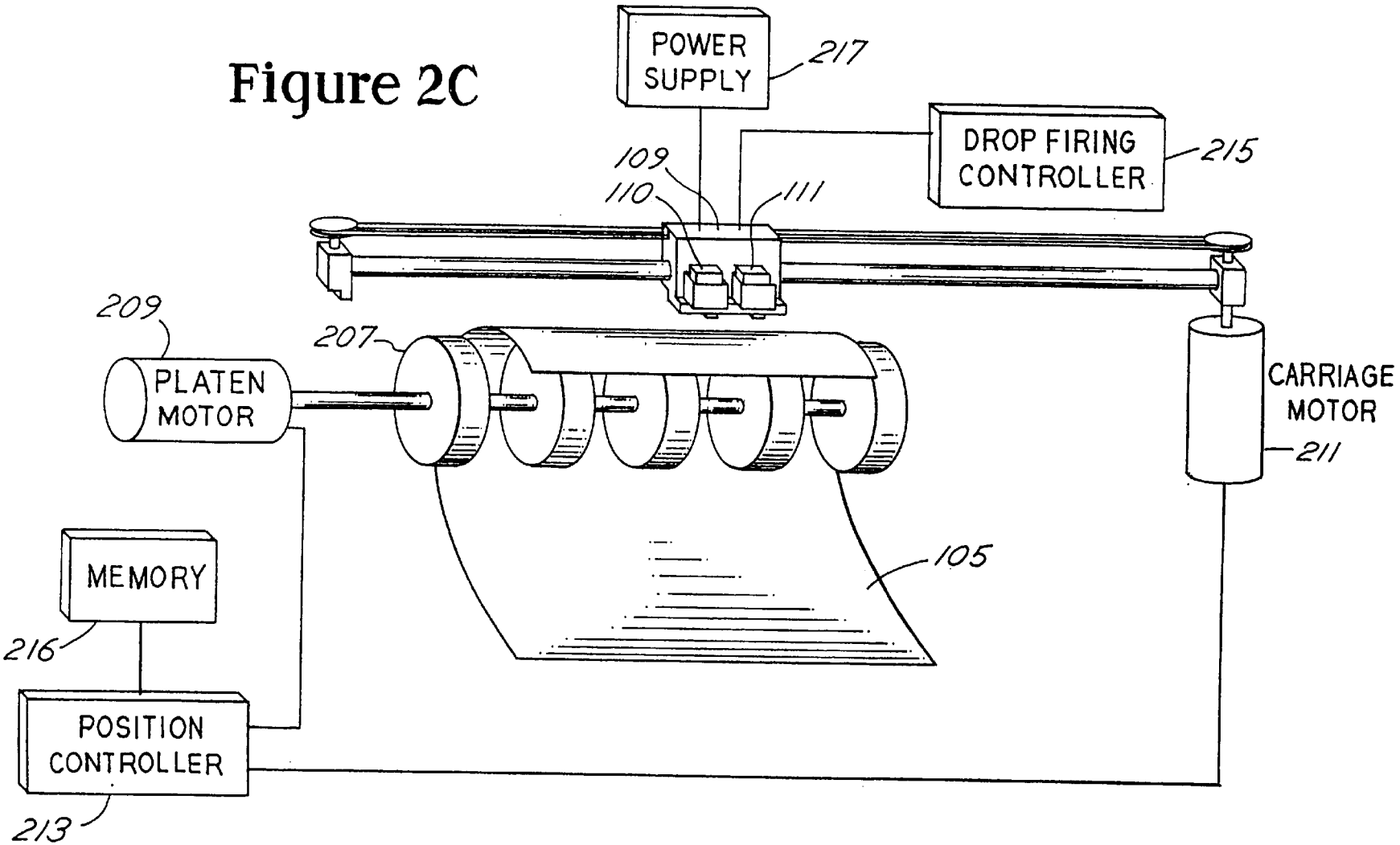
FIG. 2C is a schematic representation of the functional elements of the printer of FIG. 2A.

As can be seen in FIG. 2C, a single medium sheet is advanced from an input tray into a printer print area beneath the print heads by a medium advancing mechanism including a roller 207, a platen motor 209, and traction devices (not shown). In a preferred embodiment, the inkjet print cartridges 110, 111 are incrementally drawn across the medium 105 on the platen by a carriage motor 211 in the X direction, perpendicular to the Y direction of entry of the medium. The platen motor 209 and the carriage motor 211 are typically under the control of a media and cartridge position controller 213. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 105 is positioned in a location so that the print cartridges 110 and 111 may eject drops of ink to place dots on the medium as instructed by the data that is input to a drop firing controller 215 and power supply 217 of the printer. These dots of ink are formed from the ink drops expelled from the selected orifices in the print head in a band parallel to the scan direction as the print cartridges 110 and 111 are translated across the medium by the carriage motor 211. When the print cartridges 110 and 111 reach the end of their travel at an end of a print swath on the medium 105, the medium is conventionally incrementally advanced by the position controller 213 and the platen motor 209. Once the print cartridges have reached the end of their traverse in the X direction on the slide bar, they are either returned back along the support mechanism while continuing to print or returned without printing. The medium may be advanced by an incremental amount equivalent to the width of the ink ejecting portion of the print head or some fraction thereof related to the spacing between the nozzles. Control of the medium, positioning of the print cartridge, and selection of the correct ink ejectors for creation of an ink image or character is determined by the position controller 213. The controller may be implemented in a conventional electronic hardware configuration and provided operating instructions from memory 216. Once printing of the medium is complete, the medium is ejected into an output tray of the printer for user removal.

A single example of an ink drop generator found within a print head is illustrated in the magnified isometric cross section of FIG. 3. As depicted, the drop generator comprises a nozzle, a firing chamber, and an ink ejector. Alternative embodiments of a drop generator employ more than one coordinated nozzle, firing chamber, and/or ink ejectors. The drop generator is fluidically coupled to a source of ink.

In FIG. 3, the preferred embodiment of an ink firing chamber 301 is shown in correspondence with a nozzle 303 and a segmented heater resistor or firing resistor 309. Many independent nozzles are typically arranged in a predetermined pattern on the orifice plate 305 so that the ink drops are expelled in a controlled pattern. Generally, the medium is maintained in a position which is parallel to the plane of the external surface of the orifice plate. The heater resistors are selected for activation in a process that involves the data input from an external computer or other data source coupled to the printer in association with the drop firing controller 215 and power supply 217. Ink is supplied to the firing chamber 301 via opening 307 to replenish ink that has been expelled from orifice 303 following the creation of an ink vapor bubble by heat energy released from the segmented heater resistor 309. The ink firing chamber 301 is bounded by walls created by the orifice plate 305, a layered semiconductor substrate 313, and barrier layer 315. In a preferred embodiment, fluid ink stored in a reservoir of the cartridge housing flows by capillary force to fill the firing chamber 301.

A more-reliable ink jet print head of the present invention includes a substrate that supports heater resistors that provide heat pulses for ejecting droplets of ink onto a medium. As depicted schematically by FIG. 4, each heater resistor 400 is individually controlled by a separate switching device 402, which is preferably a field effect transistor, or FET. Each switching device 402 has a primitive select lead 404 for transmitting power, and an address select lead 406 for opening and closing the switching device 402 through the FET gate to allow current to flow through the resistor 400. Thus, in order to heat a particular resistor 400, the particular resistor's associated switching device 402 must have its primitive lead 404 and address lead 406 active concurrently.

In the print head of the present invention, the resistors and associated FETs coupled to the resistors are arranged into groupings called primitives. There are several primitives on each substrate. Each primitive has a separate single primitive select lead that provides power to all of the resistors in the primitive. Each primitive has a ground lead coupled to the ground connections of every switching device in the primitive. To reduce the number of connections to connect to the substrate, the same ground lead can be coupled to multiple primitives.

Each switching device (FET or other transistor device) within a particular primitive is coupled to an independent or separately energizable address select lead.

During operation, the address leads are actuated one at a time in a sequence such that only a single switching device in a primitive is actuated at a time. To reduce the number of connections to the substrate, address lines are shared between primitives.

The substrate of the present invention is divided into various topographic regions that each contain at least one primitive. Within each region, the address lines are shared; each primitive has its own unique primitive select line. Alternate embodiments however might provide each region on the die with its own separate set of address lines.

Figure 5A:
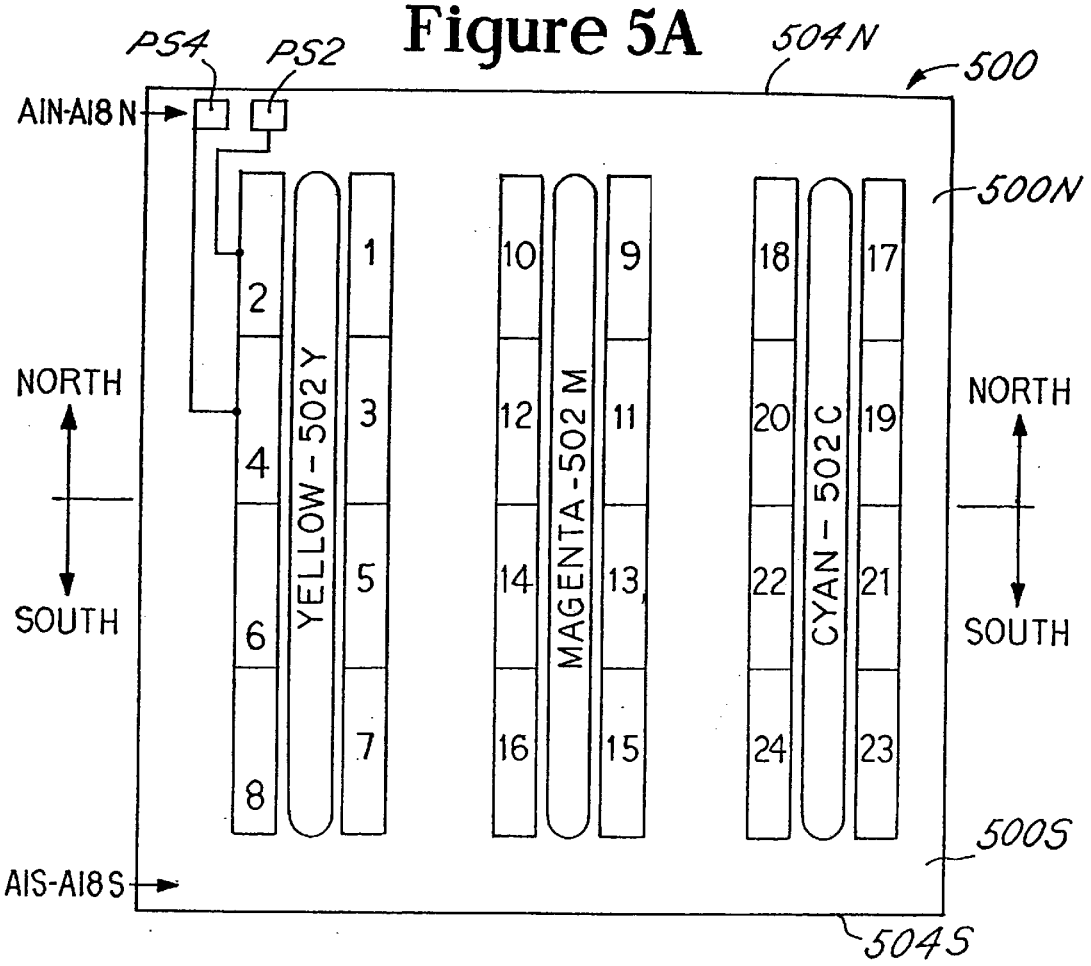
FIG. 5A is a topographic view of a print head in an embodiment of the present invention.
Figure 5B:
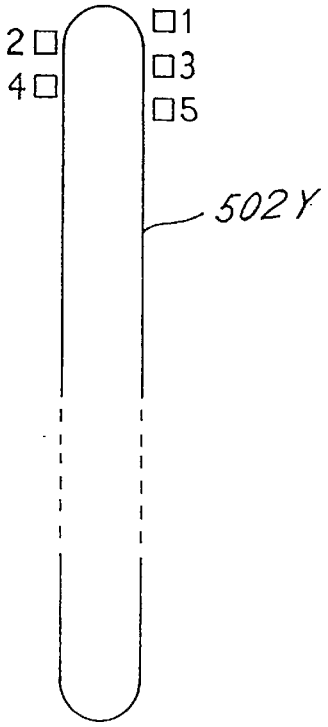
FIG. 5B is an enlarged view of an embodiment of one ink aperture and the placement of heater resistors proximate to the ink aperture.

A schematic diagram of the present invention is illustrated in FIG. 5A. A substrate 500 has three ink feed slots or ink apertures 502 through which ink from an ink reservoir feeds to firing resistors adjacent to the feed slots. Alternate embodiments would include substrates providing only a single-color aperture or other colors as well. There are three ink feed slots, one slot 502Y providing yellow, one slot 502M providing magenta, and one slot 502C providing cyan ink to the resistors. (The yellow feed slot 502Y, shown greatly enlarged along with a few firing resistors numbered 1–5, is depicted in FIG. 5B) The resistors are arranged into 24 primitives along the feed slots 502, indicated in the figure by the numbers 1–24. For example, along the ink feed slot providing yellow ink, primitives 2, 4, 6, and 8 are arranged along one side of the feed slot, and primitives 1, 3, 5, and 7 are arranged along an opposing edge of the feed slot 502Y.

In the preferred embodiment, each primitive includes 18 firing resistors (with each coupled to a separate current-controlling FET) with a single primitive select line shared between the 18 resistors within each primitive. Alternate embodiments would of course include larger as well as smaller numbers of firing resistors and transistors per primitive. Thus, for the substrate of the present invention, there are 24 independent primitive select lines PS1 to PS24 (only PS4 and PS2 shown) corresponding to the 24 primitives.

Each primitive select line routes to a connector pad located along one of two outer edges 504N or 504S of the substrate. In order for each resistor within a particular primitive to be separately energized, each resistor is connected to a current-controlling transistor, each having a separate address line (not shown).

Figure 6B:
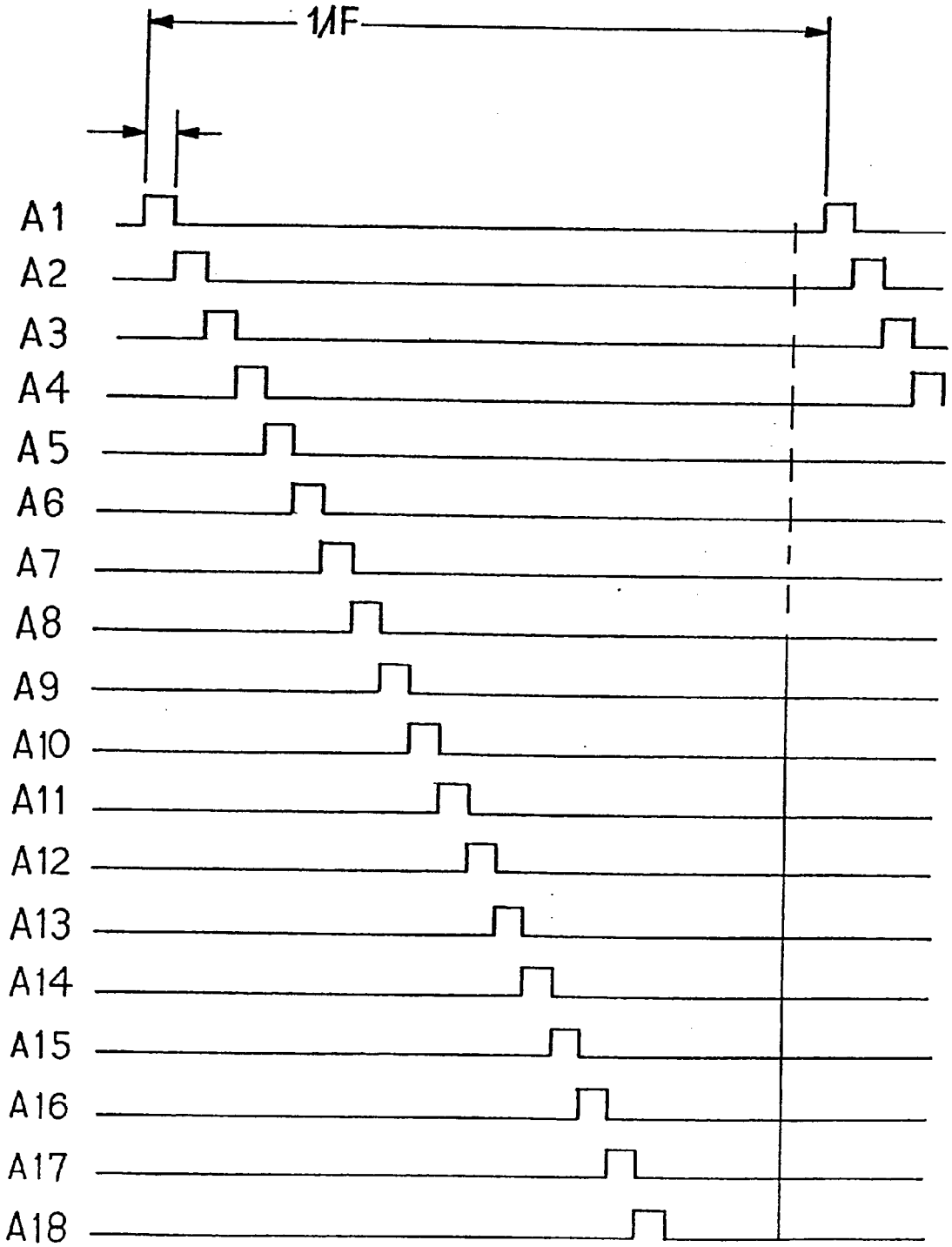
FIG. 6B illustrates the address activation sequence in one embodiment of the present invention.

During a printing operation, the printer cycles through the addresses as depicted in FIG. 6B such that only a single one of the 18 firing resistors within a particular primitive is operated at a time, i.e. sequentially. However, resistors in different primitives may be operated simultaneously. For this reason, and to minimize a number of contacts, primitives share address lines. Thus, for a given set of primitives sharing address lines, there are 18 address lines to allow for independent operation of addresses for a particular primitive.

To improve reliability and to allow multiple modes of operation, the primitives of the substrate are segregated into groups. One group of primitives is addressed by a first set of address lines for the primitives in the group. A second group of primitives is addressed by a separate set of address lines for the second group. The two groups of primitives are divided into regions that are designated as north 500N and south 500S for purposes of identification. In this example, half of the primitives are contained in region 50ON closest to substrate edge 504N. The other half of the primitives are contained in region 500S closest to the substrate edge 504S. Alternate embodiments include dividing the primitives in uneven groups spread across the substrate in any ratio.

One set of 18 address select lines, referred to as A1N, A2N, . . . , A18N, provide address select signals to the switching devices in the region 500N. Another set of 18 address select lines, referred to as A1S, A2S, . . . A18S provide address select signals to the switching devices in the region 504S.

Providing separate north and south (or upper and lower) address leads to the transistors in the primitives in the north and south regions provides several benefits. First, the susceptibility to losing an address connection is reduced by one half. Second, by having independent sets of address leads for the separate groups of primitives, multiple firing modes are enabled for the same print head. As discussed before, print heads are operated by cycling through address lines as is indicated by FIG. 6B. By having north and south primitives, the print head can be operated as having either 24 or having 12 primitives.

Address pairs of the north and south groups can be electrically or functionally "tied" together by appropriate circuitry so that combinations of transistors in any combination of groups can be fired together. In one such embodiment, each time a particular north address is activated (for example A1N), the corresponding south address is simultaneously activated (for example, A1S). This can be done by making A1N electrically common with A1S, A2N electrically common with A2S, etc. using any appropriate circuitry. This allows for higher speed or higher frequency printing, because it takes less time to cycle through the addresses (again view FIG. 6B).

On the other hand, the print head can also be operated as having 12 primitives. This can be done by serially cycling through all of the south addresses and then all of the north addresses. Although slower, this provides the opportunity to make pairs of primitive select lines electrically common but keeping the address lines electrically isolated. This reduces the cost of the switching electronics utilized to energize the primitives, reducing the cost of the printing system.

It should be recognized that in addition to the thermal inkjet embodiment described above, this invention is also applicable to alternative drop formation technologies including, for example, medical devices.

In sum, a print head for an inkjet printer includes a substrate upon which is disposed a plurality of heater resistors. The heater resistors are electrically ordered into a first group and a second group; they are physically arranged about the opposing sides of an elongated slot (an ink aperture) through which ink flows from an ink reservoir to ink firing chambers of the ink jet print head. The resistors are heated by electrical current that is directed by switching devices such as three-terminal current switching field-effect transistors or FETs. Electrical control signals to the various FETs (which allow the heater resistors to be energized) are coupled into the print head using two (2) connectors on opposites of the substrate.

One electrical connector disposed on a first side of the substrate is provided with electrical paths between the contacts of the connector and the gate inputs of the various firing transistors that are electrically coupled to only a first group of ink firing elements (resistors) that coincidentally are proximate to a first portion of the ink aperture. A second electrical connector disposed on a second side of the substrate that is opposite the first side, is provided with electrical paths between the second connector and the gate inputs of a second group of transistors that are used to fire a second group of heater resistors. Stated alternatively, the control inputs for the several transistors are divided into two groups where each group is electrically coupled to one of two edge connectors. A fault on one of the address lines controlling one of the transistors will disable only that transistor or other transistors coupled to that same address line. The control signals from the other connector, which are electrically isolated from the first connector, are not affected by ground (or other) faults adversely affecting signals on the opposite connector. Using two edge connectors to control inputs to the transistors significantly increases the print head reliability in that functionality of at least some of the ink ejectors is retained, even if a group of other ink ejectors is disabled.

While the present invention has been disclosed with reference to the foregoing specification and the preferred embodiment shown in the drawings and described above, it will be apparent to those skilled in the art that changes in form and detail may be made therein without departing from the spirit and scope of the invention as defined by the appended claims.

We claim:

1. A printer comprising:

a controller, including first and second sets of electrically isolated address lines for controlling a print head, said first and second sets of electrically isolated address lines each being comprised of a plurality of address lines;

a print media transport; and a print head assembly including:

a substrate having a first major surface through which extends a fluid aperture and on which is formed:

a first primitive, said first primitive being comprised of a first set of current-controlling transistor devices, a first terminal of each transistor device of said first set of current-controlling transistor devices being coupled to a predetermined address line of said first set of address lines; and a second primitive, said second primitive being comprised of a second set of current-controlling transistor devices, a first terminal of each transistor device of said second set of current-controlling transistor devices being coupled to a predetermined address line of said second set of address lines, said first and second sets of address lines being electrically isolated from each other;

said controller being configurable to operate and control said first and second sets of address lines in a first mode wherein predetermined ones of said first set of address lines are electrically coupled to corresponding predetermined ones of said second set of address lines and in a second mode wherein predetermined ones of said first set of address lines is electrically isolated from said second set of address lines, whereby each transistor in said first primitive and each transistor in said second primitive can be selectively activated by way of control signals on said first and second sets of address lines in each of said first and second modes.

2. The printer of claim 1 further comprising first and second sets of primitive control lines from said controller, predetermined ones of said first set of primitive control lines from said controller being coupled to a predetermined second terminal of a first transistor device of said first set of current-controlling transistor devices, predetermined ones of said second set of primitive control lines from said controller being coupled to a predetermined second terminal of a second transistor device of said second set of current-controlling transistor device wherein said first set of primitive control lines and said second set of primitive control lines are operable in a first mode wherein corresponding ones of said first and second sets of primitive control lines are coupled together and in a second mode wherein said predetermined ones of first and second primitive control lines are electrically isolated from each other.

3. The printer of claim 1 wherein a number of current-controlling transistor devices of said first primitive and a number of current-controlling transistor devices of said second primitive are different numbers.

4. A fluid ejection device comprising:

a substrate including a first region and a second region;

a first set of primitives within said first region and a second set of primitives electrically isolated from said first set of primitives, within said second region, each primitive of said first and second sets of primitives having a plurality of electrically isolated resistors and associated multiplexing circuitry, the multiplexing circuitry directing electrical current through the resistors; and a first set of address conductors electrically coupled only to the multiplexing circuitry in the first region and a second set of address conductors electrically coupled only to the multiplexing circuitry in the second region, said first and second sets of address conductors extending to first and second sets of contacts pads on said substrate.

5. The device of claim 4 wherein the number of primitives of said first set of primitives and the number of primitives of said second set of primitives are unequal numbers.

6. The device of claim 4 wherein a number of primitives of said first set of primitives is different from a number of primitives of said second set of primitives.

7. A fluid ejection device comprising:

a substrate through which extends a fluid feed aperture;

a first primitive formed onto the substrate, the first primitive having a first set of current-controlling transistors, a first terminal of =each transistor of said first set being coupled to at least one address line in a first set of address lines;

a second primitive formed onto the substrate, said second primitive having a second set of current-controlling transistors, a first terminal of each transistor of said second set being coupled to at least one address line in a second set of address lines, said second set of address lines being electrically isolated from said first set of address lines;

whereby each transistor in said first primitive can be activated independently of each transistor in that said second primitive by way of control signals on at least one address line of said first and second set of address lines.

8. The device of claim 7 wherein a number of current-controlling transistors of said first primitive and a number of current-controlling transistors of said second primitive are different numbers.

9. The device of claim 7 wherein said first and second address lines are electrically coupled together.

10. A print cartridge comprising:

a fluid reservoir; and a substrate having:

a fluid aperture through which fluid flows from said fluid reservoir to a plurality of fluid energizing elements;

a plurality of primitives, each of which is physically adjacent to said fluid aperture on said substrate, said plurality of primitives being subdivided into:

a first subset of primitives, each primitive of said first subset of primitives being comprised of a set of current-controlling transistors, a first terminal of each current-controlling transistor being coupled to an associated ink energizing element, a second terminal of each transistor being coupled to ground and the third terminal of each transistor being coupled to a predetermined address line in a first set of address lines;

a second subset of primitives, each primitive of said second subset of primitives being comprised of a set of current-controlling transistors, a first terminal of each current-controlling transistor being coupled to an associated ink energizing element, a second terminal of each transistor being coupled to ground and the third terminal of each transistor being coupled to a predetermined address line in a second set of address lines, said first set of address lines being electrically isolated from said second set of address lines.

11. The print cartridge of claim 10 wherein the number of primitives of said first set of primitives and the number of primitives of said second set of primitives are unequal numbers.

12. A printing apparatus comprising:

a fluid ejection device having:

a substrate including a first region and a second region, a first set of primitives within said first region and a second set of primitives electrically isolated from said first set of primitives, within said second region, each primitive of said first and second sets of primitives having a plurality of electrically isolated resistors and associated multiplexing circuitry, the multiplexing circuitry directing electrical current through the resistors, and a first set of address conductors electrically coupled only to the multiplexing circuitry in the first region and a second set of address conductors electrically coupled only to the multiplexing circuitry in the second region, said first and second sets of address conductors extending to first and second sets of contacts pads on said substrate; and a controller operating the first and second set of address lines having:

a first mode wherein predetermined ones of said first set of address lines are electrically coupled to corresponding predetermined ones of said second set of address lines, and a second mode wherein predetermined ones of said first set of address lines is electrically isolated from said second set of address lines;

whereby each transistor in said first primitive and each transistor in said second primitive can be selectively activated by way of control signals on said first and second sets of address lines in each of said first and second modes.

13. The printing apparatus of claim 12 wherein a number of primitives of said first set of primitives is different from a number of primitives of said second set of primitives.

14. A printer comprising:

a controller;

a print media transport;

a print head assembly including:

a substrate through which extends a fluid aperture and on which is formed:

a first primitive, said first primitive being comprised of a first set of current-controlling transistors, a first terminal of each transistor of said first set being coupled to at least one address line in a first set of address lines;

a second primitive, electrically isolated from said first primitive, said second primitive being comprised of a second set of current-controlling transistors, a first terminal of each transistor of said second set being coupled to at least one address line in a second set of address lines, said second set of address lines being electrically isolated from said first set of address lines;

whereby each transistor in said first primitive can be activated independently of each transistor in that said second primitive by way of control signals on at least one address line of said first and second set of address lines, wherein a number of current-controlling transistors of said first primitive and a number of current-controlling transistors of said second primitive are different.

* * * * *

UNITED STATES PATENT AND TRADEMARK OFFICE

CERTIFICATE OF CORRECTION

PATENT NO. : 6,431,686 B2
DATED : August 13, 2002
INVENTOR(S) : Saul et al.

It is certified that error appears in the above-identified patent and that said Letters Patent is hereby corrected as shown below:

Column 13,
Line 43, “of=each” should read -- of each --.

Signed and Sealed this

Fourth Day of March, 2003

JAMES E. ROGAN
*Director of the United States Patent and Trademark Office*